US011065628B2

(12) United States Patent
Davison et al.

(10) Patent No.: US 11,065,628 B2
(45) Date of Patent: Jul. 20, 2021

(54) CENTRIFUGE TILE ASSEMBLY

(71) Applicant: Kennametal Inc., Latrobe, PA (US)

(72) Inventors: Robert J. Davison, Pittsburgh, PA (US); Nathan G. Wood, Victoria (CA); Travis E. Puzz, Fayetteville, AR (US)

(73) Assignee: KENNAMETAL INC., Latrobe, PA (US)

( * ) Notice: Subject to any disclaimer, the term of this patent is extended or adjusted under 35 U.S.C. 154(b) by 88 days.

(21) Appl. No.: 16/030,155

(22) Filed: Jul. 9, 2018

(65) Prior Publication Data

US 2020/0009582 A1 Jan. 9, 2020

(51) Int. Cl.
*B04B 1/20* (2006.01)

(52) U.S. Cl.
CPC ..... *B04B 1/2008* (2013.01)

(58) Field of Classification Search
CPC ..... B04B 1/2008; B04B 7/12
USPC ..... 366/64–67, 318–324; 494/53–54; 198/657–677; 100/145–150
See application file for complete search history.

(56) References Cited

U.S. PATENT DOCUMENTS 3,469,824 A * 9/1969 Futty ..... B01F 7/00025 366/64
3,485,341 A * 12/1969 Lutz ..... B65G 33/26 198/664
3,674,217 A 7/1972 Reinhall
3,762,537 A * 10/1973 Lutz ..... E01C 19/48 198/664
3,764,062 A * 10/1973 Brautigam ..... B04B 1/20 494/54
3,812,564 A 5/1974 Shapiro
3,977,515 A 8/1976 Lewoczko
D254,257 S 2/1980 Ackers et al.
4,328,925 A 5/1982 Shapiro
4,519,496 A * 5/1985 Ludvigsen ..... B04B 1/2008 198/676
4,846,728 A 7/1989 Roman
4,961,722 A 10/1990 Taylor et al.
D342,745 S 12/1993 Nastren et al.
5,845,764 A 12/1998 Ommundsen
6,182,817 B1 2/2001 Rinker et al.
(Continued)

FOREIGN PATENT DOCUMENTS

DE 3140364 A1 * 4/1983 ..... B04B 1/2008
DE 19951663 A1 4/2000
(Continued)

OTHER PUBLICATIONS

Mar. 7, 2019 Foreign OA.
(Continued)

*Primary Examiner* — Charles Cooley
(74) *Attorney, Agent, or Firm* — Larry R. Meenan

(57) ABSTRACT

Wear resistant centrifuge tile assemblies include a backing portion and a wear-resistant tile. Wear resistant centrifuge tile assemblies are provided with self-fixturing features to provide a desired mounting position and to restrict movement of the wear-resistant tile with respect to the backing plate during bonding. The self-fixturing features provide the ability to perform repeatable and consistent bonding of the wear-resistant tile to the backing plate. The bonding of the wear-resistant tile to the backing plate can be performed with a braze material.

21 Claims, 6 Drawing Sheets

(56) References Cited

U.S. PATENT DOCUMENTS

| | | | | |
|---|---|---|---|---|
| 6,206,818 | B1 | 3/2001 | Deschamps | |
| 6,230,960 | B1 | 5/2001 | Deschamps | |
| 7,003,928 | B2 | 2/2006 | Patterson et al. | |
| 7,247,133 | B2 | 7/2007 | Gronnegaard et al. | |
| D636,646 | S | 4/2011 | Muccino et al. | |
| D690,233 | S | 9/2013 | Manchik | |
| 8,672,243 | B2 | 3/2014 | Turcic et al. | |
| D745,574 | S | 12/2015 | Losen et al. | |
| D782,260 | S | 3/2017 | Chiu | |
| 9,694,434 | B2 | 7/2017 | Sjodin et al. | |
| 2006/0166803 | A1 | 7/2006 | Schulz et al. | |
| 2010/0016140 | A1* | 1/2010 | Dietschreit | B04B 1/2008 494/42 |
| 2011/0281716 | A1* | 11/2011 | Hurd | B04B 1/2008 494/54 |
| 2012/0004088 | A1 | 1/2012 | Kopper et al. | |
| 2013/0167740 | A1* | 7/2013 | Doppstadt | B65G 33/26 100/145 |
| 2014/0038806 | A1 | 2/2014 | Lendzian et al. | |
| 2016/0199931 | A1 | 7/2016 | Sjodin et al. | |
| 2020/0009582 | A1* | 1/2020 | Davison | B04B 1/2008 |

FOREIGN PATENT DOCUMENTS

| | | | | | |
|---|---|---|---|---|---|
| DE | 102006058431 | A1 | | 6/2008 | |
| DE | 102007046193 | A1 | | 4/2009 | |
| JP | 58119362 | A | * | 7/1983 | B04B 1/2008 |
| JP | 03127643 | A | * | 5/1991 | B04B 1/2008 |
| JP | H0663447 | A | | 3/1994 | |
| JP | H0663448 | A | | 3/1994 | |
| JP | H07171439 | A | | 7/1995 | |
| JP | H07289942 | A | | 11/1995 | |
| JP | 2001190985 | A | | 7/2001 | |
| JP | 2012-000551 | | * | 1/2012 | |
| KR | 100883924 | B1 | | 2/2009 | |
| KR | 20120118635 | A | | 10/2012 | |
| KR | 20140050160 | A | | 4/2014 | |
| WO | 2020/141317 | A1 | * | 7/2020 | |

OTHER PUBLICATIONS

Oct. 15, 2019 Foreign OA.
May 23, 2019 Foreign OA.
Apr. 2, 2019 Notice of Allowance.
Apr. 3, 2020 Foreign OA.
Mar. 20, 2020 Notice of Allowance.
Feb. 11, 2020 Foreign OA.
Dec. 18, 2019 Foreign OA.
U.S. Appl. No. 30/167,740, filed Aug. 9, 2016, Johann Doppstadt;Horst Berger.
U.S. Appl. No. 60/107,172, filed Mar. 6, 2018, Denis Lamy;Jean-Marc Huyghe.

* cited by examiner

CENTRIFUGE TILE ASSEMBLY

FIELD OF THE INVENTION

The present invention relates to centrifuge tile assemblies, and more particularly relates to decanter centrifuge tile assemblies with features to ensure a proper and consistent bond between a backing plate and a wear-resistant tile.

BACKGROUND INFORMATION

Decanter centrifuges are utilized for separating solids from liquids in operations such as, oil sand extraction, drilling and mining dewatering, wastewater treatment, and the like. The conveyor surfaces of centrifuges are provided with tiles comprised of hard surfacing and protective materials to reduce wear and required maintenance of the conveyor surfaces caused by abrasive materials.

In a conventional arrangement, a wear-resistant tile with a planar bottom surface is bonded to a backing plate with a planar top surface. However, the wear-resistant tile is often misaligned on the backing plate prior to bonding and can cause a side of the wear-resistant tile to extend beyond a side of the backing plate after they are bonded together. The misalignment may result in contact with an adjoining tile assembly when installed on a helical screw or scroll of the decanter centrifuge. The joint between the wear-resistant tile and the backing plate typically is the critical failure point for decanter centrifuge tile assemblies. Decanter centrifuge tile assembly failure leads to costly downtime for liquid and solid separation operations. To help prevent the failure of the bonded joint, the bonding of each tile must be completed properly and consistently, because when a proper bond is not performed, corrosion and abrasion may attack the joint and lead to catastrophic failure. A single failed tile assembly has the potential to jam or destroy the entire machine.

SUMMARY OF THE INVENTION

Centrifuge tile assemblies are provided that include a backing plate and a wear-resistant tile with mounting features to enable proper and consistent alignment and bonding. The backing plate and the wear-resistant tile each comprise self-fixturing features to provide a desired mounting position for the wear-resistant tile on the backing plate. The self-fixturing features restrict movement and position the abutting faces of the wear-resistant tile and backing plate at a selected distance to allow for proper and consistent bonding to form the centrifuge tile assembly.

An aspect of the present invention is to provide a centrifuge tile assembly comprising a backing plate comprising a generally planar top seating face extending from a front edge of the backing plate toward a vertical seating face of a rear mounting shoulder of the backing plate, and a wear-resistant tile comprising a front edge, a rear seating edge, first and second sides and a generally planar bottom seating face, wherein the backing plate and the wear-resistant tile define an X-axis parallel with a plane of the generally planar top seating face of the backing plate, parallel with a plane of the generally planar bottom seating face of the wear-resistant tile, and extending parallel to the rear seating edge of the wear-resistant tile, and a Y-axis parallel with the plane of the generally planar top seating face of the backing plate, parallel with a plane of the generally planar bottom seating face of the wear-resistant tile, and extending normal to the rear seating edge of the wear-resistant tile, and wherein at least one protrusion or recess in the backing plate engages at least one opposing recess or protrusion in the wear-resistant tile to thereby restrict relative movement between the backing plate and the wear-resistant tile in the X-axis direction and the Y-axis direction.

Another aspect of the present invention is to provide a centrifuge tile assembly comprising a backing plate comprising a generally planar top seating face extending from a front edge of the backing plate toward a rear mounting shoulder of the backing plate, a retaining groove recessed in the generally planar top seating face, and a vertical seating face on the rear mounting shoulder extending from the generally planar top seating face of the backing plate adjacent to the retaining groove, a wear-resistant tile comprising a top surface, a front edge, a rear seating edge, first and second sides and a generally planar bottom seating face, the generally planar bottom seating face comprising at least one alignment tab extending from the generally planar bottom seating face and structured and arranged to be received within the retaining groove of the backing plate, and a first bonding layer between the generally planar top seating face of the backing plate and the generally planar bottom seating face of the wear-resistant tile, and a second bonding layer between the vertical seating face of the backing plate and the rear seating edge of the wear-resistant tile.

A further aspect of the present invention is to provide a backing plate for a centrifuge tile assembly comprising a generally planar top seating face extending from a front edge of the backing plate toward a rear mounting shoulder of the backing plate, a retaining groove recessed in the generally planar top seating face, a vertical seating face on the rear mounting shoulder extending from the generally planar top seating face of the backing plate adjacent to the retaining groove, and an alignment protrusion extending from the vertical seating face.

Another aspect of the present invention is to provide a wear-resistant tile for a centrifuge tile assembly comprising a generally planar top surface, a front edge, a rear seating edge, first and second sides and a generally planar bottom seating face, wherein the generally planar bottom seating face comprises at least one alignment tab extending from the generally planar bottom seating face structured and arranged to be received within a recessed retaining groove of a backing plate, and the rear seating edge comprises an alignment notch recessed therein structured and arranged to receive an alignment protrusion of the backing plate.

These and other aspects of the present invention will be more apparent from the following description.

DETAILED DESCRIPTION

Wear resistant centrifuge tile assemblies are provided with self-fixturing features to provide a desired mounting position and to restrict movement of a wear-resistant tile with respect to a backing plate during bonding. The self-fixturing features provide the ability to perform repeatable and consistent alignment and bonding of the wear-resistant tile to the backing plate. As understood by those skilled in the art, there is a desirable thickness for a bonding layer between the wear-resistant tile and the backing plate, at which point a maximum strength may be attained. In accordance with an embodiment of the present invention, the self-fixturing features allow for a repeatable and consistent optimal bonding layer thickness to be achieved. As used herein, the term "optimal bonding layer thickness" means the thickness at which a bonding layer, such as a brazing layer, attains its maximum strength. In accordance with an embodiment of the present invention, after the centrifuge tile assemblies are formed, the backing plates of the assemblies may be attached to a helical screw or scroll of a decanter centrifuge.

Figure 1:
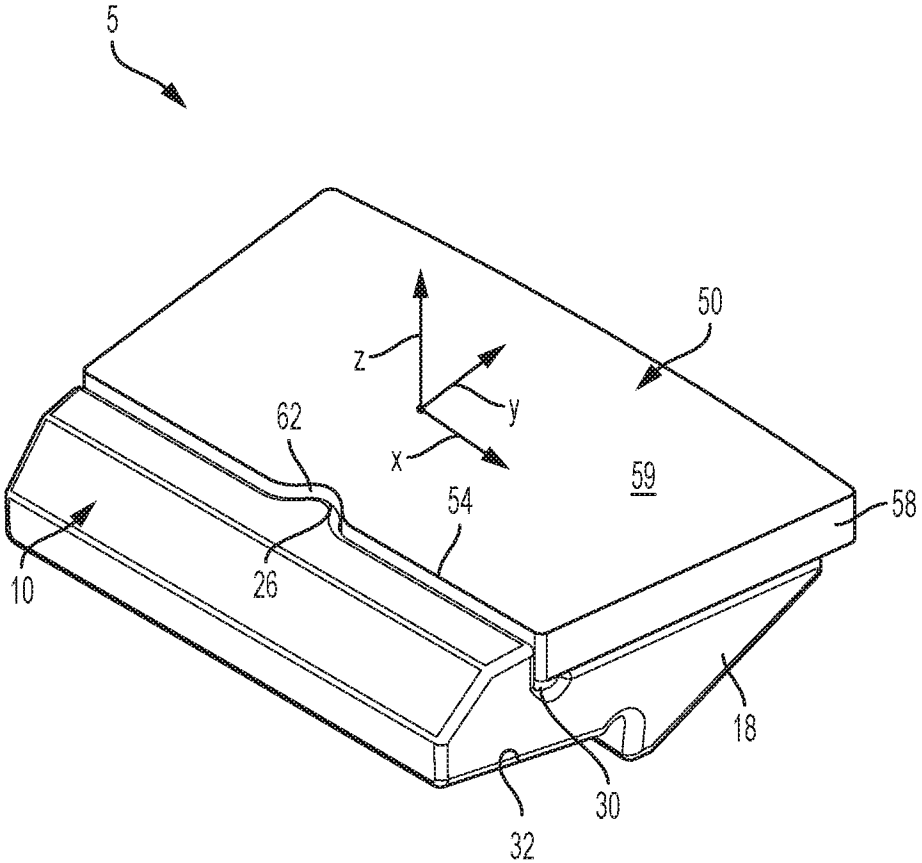
FIG. 1 is a top-rear isometric view of a centrifuge tile assembly in accordance with an embodiment of the present invention.
Figure 6:
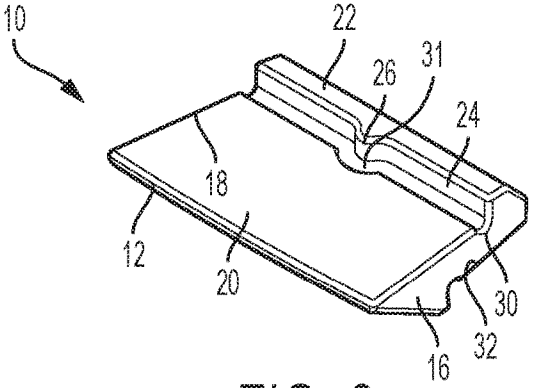
FIG. 6 is a top-front isometric view of the backing plate of FIG. 5.
Figure 10:
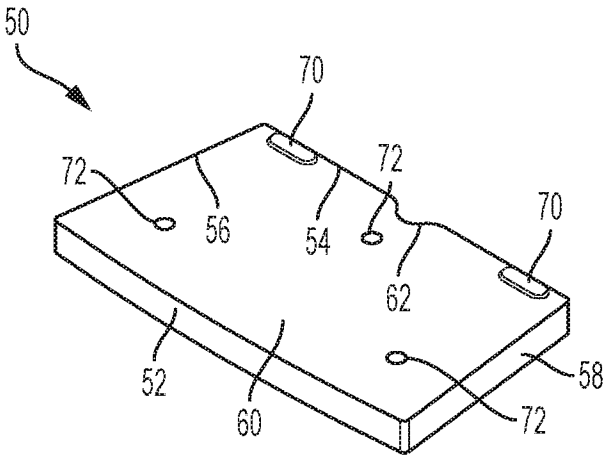
FIG. 10 is a bottom-front isometric view of a wear-resistant tile in accordance with an embodiment of the present invention.

FIG. 1 illustrates a centrifuge tile assembly 5 in accordance with an embodiment of the present invention. The centrifuge tile assembly 5 includes a backing plate 10 and a wear-resistant tile 50. As shown in FIG. 6, the backing plate 10 has a front edge 12, a rear edge 14, first and second sides 16 and 18, a generally planar top seating face 20, a rear mounting shoulder 22 and a vertical seating face 24. As shown in FIG. 10, the wear-resistant tile 50 has a front edge 52, a distal-most rear seating edge 54 opposite the front edge 52, first and second sides 56 and 58, a generally continuous and uninterrupted planar top surface 59 and a generally planar bottom seating face 60. In FIG. 1 the centrifuge tile assembly 5 is marked with X, Y and Z Cartesian coordinates to help describe the directionality of the elements of the centrifuge tile assembly 5. The X-axis is parallel with the plane of the generally planar top surface 59 of the wear-resistant tile 50 and runs parallel to its rear seating edge 54. The Y-axis is parallel with the plane of the generally planar top surface 59 of the wear-resistant tile 50, and is normal to the rear seating edge 54 of the wear-resistant tile 50. The Z-axis is normal to the generally planar top seating face 20 of the backing plate 10 and the generally planar top surface 59 and the generally planar bottom seating face 60 of the wear-resistant tile 50. In accordance with an embodiment of the present invention, the planes of the generally planar top seating face 20 of the backing plate 10, the generally planar top surface 59 and the generally planar bottom seating face 60 of the wear-resistant tile 50 may be parallel. In accordance with an embodiment of the present invention, the wear-resistant tile 50 is aligned with backing plate 10 at a selected position with respect to the X, Y and Z coordinates. As used herein, the term "vertical" means having a major component in the Z-axis direction, e.g., from 70° to 110° measured from the Y-axis, for example, from 80° to 100°, or about 90°.

Figure 2:
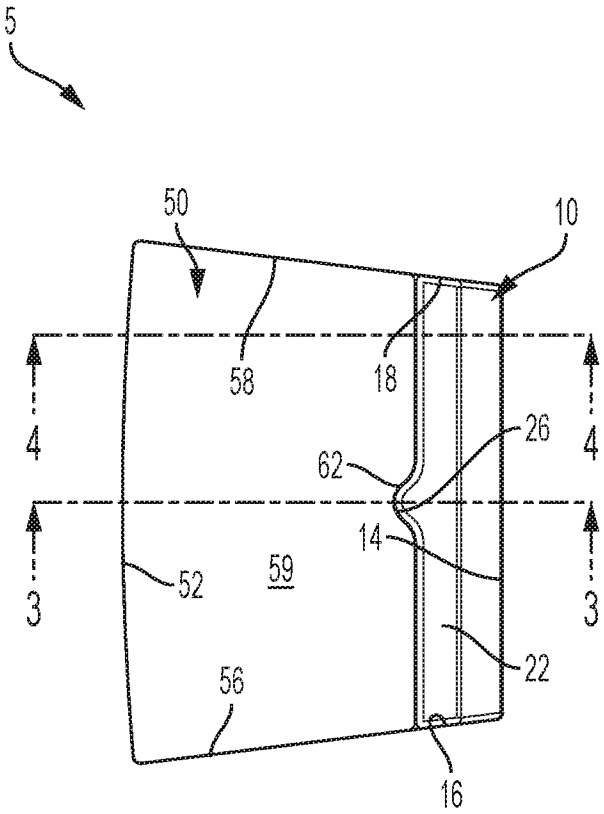
FIG. 2 is a top view of the centrifuge tile assembly of FIG. 1.

As shown in FIGS. 1 and 2, the wear-resistant tile 50 is structured and arranged to mate with the backing plate 10. In the embodiment shown, wear-resistant tile 50 is structured and arranged to allow its first and second sides 56 and 58 to align with the first and second sides 16 and 18 of the backing plate 10. Alternatively, the wear-resistant tile 50 may be sized to allow its first and second sides 56 and 58 to extend beyond the first and second sides 16 and 18 of the backing plate 10.

Figure 4:
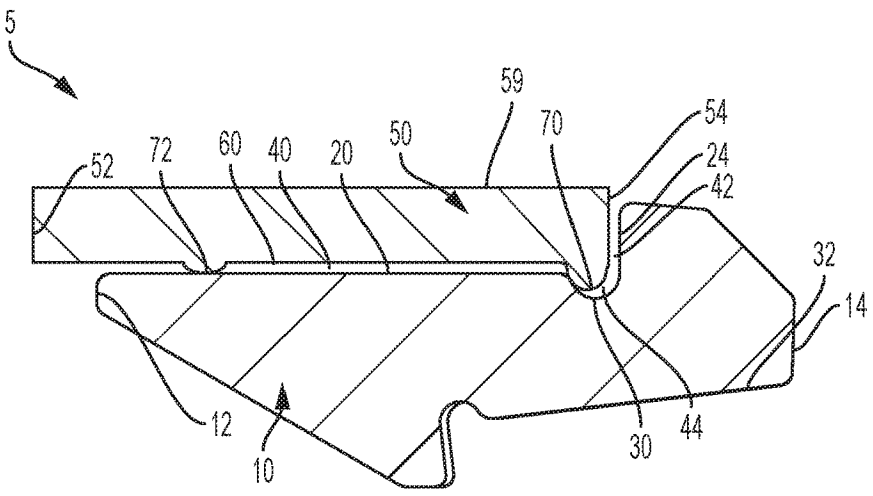
FIG. 4 is a side-sectional view of the centrifuge tile assembly taken through line 4-4 of FIG. 2.
Figure 3:
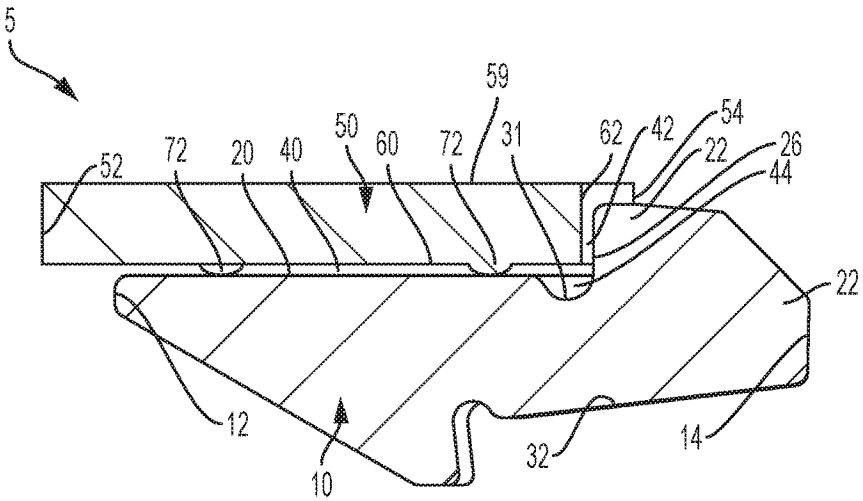
FIG. 3 is a side-sectional view of the centrifuge tile assembly taken through line 3-3 of FIG. 2.

As shown in FIGS. 1-4, the backing plate 10 and the wear-resistant tile 50 have complementary features to selectively position and align the wear-resistant tile 50 on the backing plate 10 for bonding. As shown in FIGS. 3 and 4, the Z-axis braze spacing 40, the Y-axis braze spacing 42, the braze reservoir 44, the alignment tabs 70 and the spacing feet 72 are not drawn to scale in order to more clearly show the spacings. As understood by those skilled in the art, for an optimal bonding layer thickness to be provided between the backing plate 10 and the wear-resistant tile 50, the brazing or other bonding layer may not be too thin, or too thick. In accordance with an embodiment of the present invention, the backing plate 10 and the wear-resistant tile 50 each comprise features to repeatedly and consistently allow for a first optimal bonding layer thickness to be provided between the generally planar top seating face 20 of the backing plate 10 and the generally planar bottom seating face 60 of the wear-resistant tile 50, and a second optimal bonding layer thickness to be provided between the vertical seating face 24 of the backing plate 10 and the rear seating edge 54 of the wear-resistant tile 50.

As shown in FIG. 3, when the wear-resistant tile 50 is placed onto the backing plate 10, the generally planar top seating face 20 of the backing plate 10 and the generally planar bottom seating face 60 of the wear-resistant tile 50 are aligned in parallel planes that are offset from each other. The offset between the generally planar top seating face 20 and the generally planar bottom seating face 60 forms a braze spacing 40 in the Z-axis direction. The braze spacing 40 between the generally planar top seating face 20 of the backing plate and the generally planar bottom seating face 60 of the wear-resistant tile 50 may be selected to allow for a desired optimal thickness of bonding material to form a bonding layer. For example, the thickness of the Z-axis braze spacing 40 may typically range from 0.0001 to 0.1 inch, or from 0.0005 to 0.05 inch, or from 0.001 to 0.01 inch. In a particular embodiment, the Z-axis braze spacing 40 may be 0.005 inch. In accordance with an embodiment of the present invention, the generally planar top seating face 20 of the backing plate 10 or the generally planar bottom seating face 60 of the wear-resistant tile 50 may include structural features to provide the braze spacing 40. As shown in FIG. 3, and as more fully described below, the generally planar bottom seating face 60 of the wear-resistant tile 50 may include spacing feet 72 extending away from the generally planar bottom seating face 60 to contact the generally planar top seating face 20 of the backing plate 10. The height or extension distance of the spacing feet 72 may correspond to the Z-axis braze spacing 40 described above. The spacing feet 72 help form a bonding layer having an optimal braze thickness by contacting the generally planar top seating face 20 of the backing plate 10 to form the Z-axis braze spacing 40 to prevent the bonding layer from being too thin. Pressure may be applied to the generally planar top surface 59 of the wear-resistant tile 50 during bonding to prevent the bonding layer from being too thick.

Figure 7:
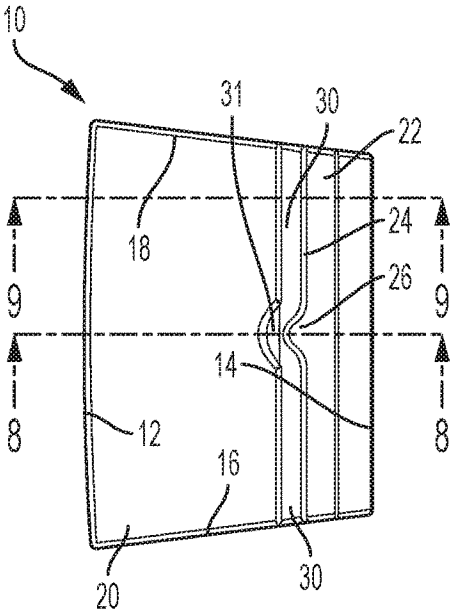
FIG. 7 is a top view of the backing plate of FIG. 5.
Figure 11:
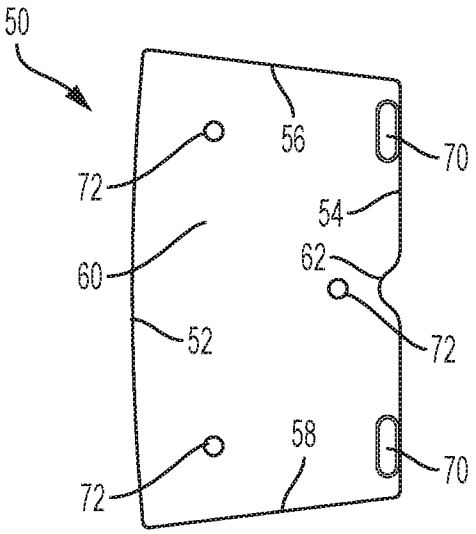
FIG. 11 is a bottom view of the wear-resistant tile of FIG. 10.

In accordance with an embodiment of the present invention, the backing plate 10 includes an alignment protrusion 26 which engages an alignment notch 62 of the wear-resistant tile 50. As used herein, the terms "engage", "engages", and "engagement" and "engaging" mean that two or more features interact with each other to restrict relative movement between the wear-resistant tile 50 and the backing plate 10. For example, at least one protrusion or recess on the backing plate 10 may engage at least one opposing recess or protrusion on the wear-resistant tile 50 to restrict movement of the wear-resistant tile 50 in the X-axis, Y-axis and/or Z-axis in relation to the backing plate 10. The alignment protrusion 26 has a Y-axis extension distance selected to correspond to a Y-axis depth of the alignment notch 62. For example, the Y-axis extension distance of the alignment protrusion 26 may typically range from 0.001 to 0.4 inch, or from 0.005 to 0.25 inch, or from 0.04 to 0.1 inch. For example, the Y-axis depth of the alignment notch 62 may typically range from 0.001 to 0.4 inch, or from 0.005 to 0.25 inch, or from 0.04 to 0.1 inch. The Y-axis extension distance of the alignment protrusion 26 is typically slightly larger than Y-axis depth of the alignment notch 62 in order to provide a desired Y-axis braze spacing 42, as more fully described below. For example, the alignment protrusion 26 may be from 0.0001 to 0.1 inch larger than the alignment notch 62, or from 0.0005 to 0.05 inch larger in order to match the desired optimal braze thickness between the vertical seating face 24 and the rear seating edge 54. As shown in FIGS. 6 and 7, the alignment protrusion 26 may extend in the Z-axis direction from the bottom of the central groove portion 31 to the top face of the rear mounting shoulder 22. In accordance with an embodiment of the present invention, the alignment protrusion 26 may not extend to the top face of the rear mounting shoulder 22, and may only extend in Z-axis direction to allow engagement with the alignment notch 62. As shown in FIG. 11, the alignment notch 62 of the wear-resistant tile 50 extends through the entire Z-axis thickness of the rear seating edge 54 of the wear-resistant tile 50. In accordance with an embodiment of the present invention, the alignment notch 62 may only extend from the generally planar bottom seating face 60 through a partial Z-axis thickness of the rear-seating edge 54 to allow engagement with the alignment protrusion 26. As shown in FIGS. 1 and 2, the alignment protrusion 26 has an X-axis length selected to correspond to an X-axis length of the alignment notch 62. The X-axis length of the alignment notch 62 is typically slightly larger than X-axis length of the alignment protrusion 26 in order to allow engagement between the alignment protrusion 26 and the alignment notch 62.

In accordance with an embodiment of the present invention, engagement between the alignment protrusion 26 and the alignment notch 62 restricts movement of the wear-resistant tile 50 toward the rear mounting shoulder 22 of the backing plate 10. In FIGS. 3 and 4, the wear-resistant tile 50 is shown at an extreme forward Y-axis position with respect to the backing plate 10 such that the alignment notch 62 receives the alignment protrusion 26 with space between the alignment protrusion 26 and the alignment notch 62. In the position shown, the alignment protrusion 26 is engaged within, but does not contact, the alignment notch 62. Alternatively, the wear-resistant tile 50 may be moved from the position shown in FIGS. 3 and 4 to an extreme rearward position with respect to the backing plate 10 such that the alignment notch 62 contacts at least a portion of the alignment protrusion 26 to provide engagement therebetween and limit further rearward movement of the wear-resistant tile 50. Limiting further rearward of the wear-resistant tile 50 allows for the Y-axis braze spacing 42 to be formed between the vertical seating face 24 of the backing plate and the rear seating edge 54 of the wear-resistant tile 50. The alignment protrusion 26 of the backing plate 10 mating with the alignment notch 62 of the wear-resistant tile 50 also provides a desired orientation between the wear-resistant tile 50 and the backing plate 10 in the X-axis and restricts movement in the X-axis during bonding. As more fully described below, limiting and controlling the orientation between the wear-resistant tile 50 and the backing plate 10 to provide proper alignment allows for repeatable and consistent bonding of the wear-resistant tile 50 to the backing plate 10.

As shown in FIGS. 3 and 4, the backing plate 10 and the wear-resistant tile 50 may have additional complementary features to selectively position and align the wear-resistant tile 50 on the backing plate 10 for bonding. In accordance with an embodiment of the present invention, the backing plate 10 includes a retaining groove 30 recessed into and below the generally planar top seating face 20 which extends from the first side 16 to the second side 18 of the backing plate 10, including a central groove portion 31, and the wear-resistant tile 50 includes alignment tabs 70 extending from the generally planar bottom seating face 60. In accordance with an embodiment of the present invention, the retaining groove 30 of the backing plate 10 receives the alignment tabs 70 of the wear-resistant tile 50 to help provide a desired orientation and alignment position between the wear-resistant tile 50 and the backing plate 10 in the Y-axis. Specifically, contact between the alignment tabs 70 and the retaining groove 30 limits further movement of the wear-resistant tile 50 away from the rear mounting shoulder 22 of the backing plate 10. In FIGS. 3 and 4, the wear-resistant tile 50 is shown at an extreme forward Y-axis position with respect to the backing plate 10 such that the retaining groove 30 receives the alignment tabs 70 with contact between a side of the retaining groove 30 and the alignment tabs 70. In the position shown, the alignment tabs 70 are engaged within, and contact, a side of the retaining groove 30 to limit further forward movement. Limiting further forward movement of the wear-resistant tile 50 may prevent the Y-axis braze spacing 42 from becoming too large in the Y-axis direction. Alternatively, the wear-resistant tile 50 may be moved from the position shown in FIGS. 3 and 4 to an extreme rearward position with respect to the backing plate 10 such that the alignment tabs 70 are engaged within, but do not contact, the retaining groove 30. As more fully described below, limiting and controlling the orientation between the wear-resistant tile 50 and the backing plate 10 to provide proper alignment allows for repeatable and consistent bonding of the wear-resistant tile 50 to the backing plate 10.

As shown in FIG. 4, when the wear-resistant tile 50 is placed onto the backing plate 10, with the alignment tabs 70 of the wear-resistant tile 50 in the retaining groove 30 of the backing plate 10, the generally planar bottom seating face 60 of the wear-resistant tile 50 is offset from the bottom surface of the retaining groove 30. The offset between the generally planar bottom seating face 60 of the wear-resistant tile 50 and bottom surface of the retaining groove 30 forms a braze reservoir 44. In accordance with an embodiment of the present invention, the braze reservoir 44 provides a corrosion inhibiting zone by ensuring that the bonding layer between the backing plate 10 and the wear-resistant tile 50 comprises the necessary amount of braze material. As more fully described below, the braze reservoir 44 provides the centrifuge tile assembly 5 with a larger barrier to an interface corrosion event, which may allow the centrifuge tile assembly 5 to stay in service longer.

As shown in FIG. 4, the alignment tabs 70 of the wear-resistant tile 50 in the retaining groove 30 of the backing plate 10 reduce the depth of the braze reservoir 44 at certain locations. For example, the Z-axis extension distance of the alignment tabs 70 may typically range from 0.001 to 0.25 inch, or from 0.005 to 0.1 inch, or from 0.01 to 0.05 inch. In a particular embodiment, the alignment tabs 70 may have a Z-axis extension distance of 0.027. In accordance with an embodiment of the present invention, the alignment tabs 70 are offset from the bottom surface of the retaining groove 30 by a desired minimum distance in the Z-axis. For example, the Z-axis depth of the retaining groove may typically range from 0.001 to 0.3 inch, or from 0.005 to 0.15 inch, or from, 0.01 to 0.075 inch. In a particular embodiment, the retaining groove may have a Z-axis depth of 0.03 inch. The retaining groove 30 having a Z-axis depth greater than the Z-axis extension distance of the alignment tabs allows for a desired amount of bonding material to form a bonding layer between the alignment tabs 70 and the retaining groove 30.

In accordance with an embodiment of the present invention, the Y-axis width of the alignment tabs 70 do not fill the entire Y-axis width of the retaining groove 30. As shown in FIG. 4, the alignment tabs 70 do not completely fill the retaining groove 30. For example, the Y-axis width of the alignment tabs 70 may typically range from 0.001 to 0.25 inch, or from 0.005 to 0.1 inch, or from, 0.025 to 0.075 inch. The Y-axis width of the retaining groove 30 may typically range from 0.005 to 0.3 inch, or from 0.01 to 0.15 inch, or from, 0.04 to 0.08 inch. This arrangement allows the alignment tabs 70 to contact only a single side of the retaining groove 30.

As shown in FIG. 4, when the wear-resistant tile 50 is placed onto the backing plate 10, with the alignment protrusion 26 of the backing plate 10 in the alignment notch 62 of the wear-resistant tile 50, and the alignment tabs 70 of the wear-resistant tile 50 in the retaining groove 30 of the backing plate 10, the rear seating edge 54 of the wear-resistant tile 50 and a vertical seating face 24 of the backing plate 10 are aligned in parallel planes that are offset from each other. The offset between the vertical seating face 24 and the rear seating edge 54 forms a braze spacing 42 in the Y-axis direction. The Y-axis braze spacing 42 between the vertical seating face 24 of the backing plate 10 and the rear seating edge 54 of the wear-resistant tile 50 may be selected to allow for a desired amount of bonding material to form a bonding layer. For example, the thickness of the Y-axis braze spacing 42 my typically range from 0.0001 to 0.1 inch, or from 0.0005 to 0.05 inch, or from 0.001 to 0.01 inch. In a particular embodiment, the Y-axis braze spacing 42 may be 0.005 inch. As shown in FIGS. 2-4, and as more fully described below, the alignment protrusion 26 and the retaining groove 30 of the backing plate 10 and the alignment notch 62 and the alignment tabs 70 of the wear-resistant tile 50 interact to provide the desired Y-axis braze spacing 42.

As further shown in FIG. 4, the wear-resistant tile 50 being placed on the backing plate 10 at a forward Y-axis position presses the alignment tabs 70 of the wear-resistant tile 50 against a side the retaining groove 30 of the backing plate 10 and provides the braze spacing 42 between the vertical seating face 24 of the backing plate 10 and the rear seating edge 54 of the wear-resistant tile. These features of the backing plate 10 and the wear-resistant tile 50 being brought into contact provide a desired orientation between the wear-resistant tile 50 and the backing plate 10 in the Y-axis direction. As such, the features allow the wear-resistant tile 50 to stay within mounting tolerances on the backing plate 10. In addition, the alignment protrusion 26 and the alignment notch 62 provide a consistent braze spacing 42 between the vertical seating face 24 of the backing plate 10 and the rear seating edge 54 of the wear-resistant tile 50 to allow for the desired optimal bonding layer thickness.

Figure 5:
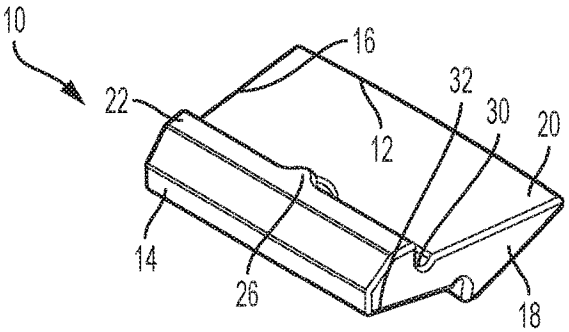
FIG. 5 is a top-rear isometric view of a backing plate in accordance with an embodiment of the present invention.

As shown in detail in FIG. 5, the backing plate 10 includes the front edge 12, the rear edge 14, first and second sides 16 and 18, and the generally planar top seating face 20. In the embodiment shown, the first and second sides 16 and 18 extend from the rear edge 14 to the front edge 12 at an outward angle to form a generally trapezoidal backing plate 10. However, any other suitable shape of backing plate may be used, e.g., rectangular, square, triangular, or the like. In accordance with an embodiment of the present invention, the front edge 12 extending from the first side 16 to the second side 18 may be curved, however any other suitable shape may be used, e.g., a straight edge.

As shown in detail in FIGS. 6 and 7, the generally planar top seating face 20 of the backing plate 10 extends from the front edge 12 toward the rear mounting shoulder 22 and the retaining groove 30. In accordance with an embodiment of the present invention, the rear mounting shoulder 22 extends from the backing plate 10 to form the vertical seating face 24. In the embodiment shown, the vertical seating face 24 extends from the retaining groove 30 that is recessed into and below the generally planar top seating face 20 in a direction normal to the generally planar top seating face 20. The vertical seating face 24 includes the alignment protrusion 26 integrally formed with and extending from the vertical seating face 24 towards the front edge 12 of the backing plate 10. As seen in FIGS. 6 and 7, the alignment protrusion 26 extends from the retaining groove 30 below the generally planar top seating face 20.

A generally semicircular cross-section of the alignment protrusion 26 is shown in FIG. 7. However, any other suitable shape or type of alignment protrusion 26 cross-sectional shape may be used, e.g., rectangular, square, triangular, serrated, complex curved, or the like. In the embodiment shown, there is a single centrally located alignment protrusion 26, but any other suitable number and location of alignment protrusion(s) may be used, e.g., the vertical seating face 24 may include more than one alignment protrusion spaced along the vertical seating face. In accordance with an embodiment of the present invention, if the vertical seating face 24 may include more than one alignment protrusion 26, each alignment protrusion may be of the same or different shape.

As shown in FIGS. 6 and 7, the retaining groove 30 is recessed in the generally planar top seating face 20 adjacent to the vertical seating face 24 of the rear mounting shoulder 22. In the embodiment shown, the retaining groove 30 extends from the first side 16 to the second side 18 of the backing plate 10 with a consistent Z-axis depth and Y-axis width. However, the Z-axis depth and Y-axis width of the retaining groove 30 may be varied from the first side 16 to the second side 18 of the backing plate 10. In the embodiment shown, the retaining groove 30 follows along the vertical seating face 24 of the rear mounting shoulder 22. As shown in FIGS. 6 and 7, the retaining groove 30 comprises a central groove portion 31 that follows along the alignment protrusion 26 of the rear mounting shoulder 22. In the embodiment shown, the central groove portion 31 has the same Z-axis depth and Y-axis width as the rest of the retaining groove 30, however, any other suitable arrangement may be used. For example, the central groove portion 31 may have a Z-axis depth that is less than the Z-axis depth of the retaining groove 30. The Z-axis depth of the retaining groove 30 outside of the central groove portion 31 may be greater to accommodate the alignment tabs 70 of the wear-resistant tile 50 while maintaining a minimum bonding layer thickness.

Figure 9:
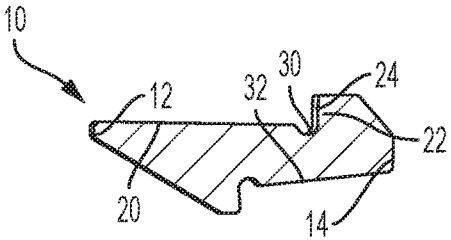
FIG. 9 is a side-sectional view of the backing plate taken through line 9-9 of FIG. 6.
Figure 8:
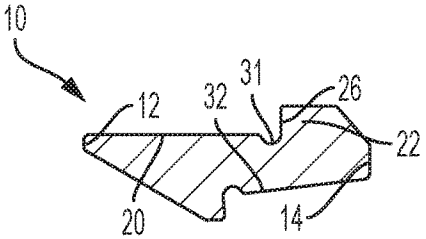
FIG. 8 is a side-sectional view of the backing plate taken through line 8-8 of FIG. 6.

As shown in FIGS. 8 and 9, the retaining groove 30 comprises a generally semicircular cross-section. However, any other suitable cross-sectional shape of retaining groove may be used, e.g., rectangular, square, trapezoidal, hexagonal, ovular, triangular, or the like. As shown in FIGS. 8 and 9, a first side of the retaining groove 30 transitions into the generally planar top seating face 20 and a second side of the retaining groove 30 transitions into the vertical seating face 24. In accordance with an embodiment of the present invention, the semicircular retaining groove 30 allows the bonding material to flow into the braze reservoir 44 formed by the retaining groove 30 and then between the rear seating edge 54 and the vertical seating face 24 of the rear mounting shoulder 22 to form a complete bonding layer between the backing plate 10 and the wear-resistant tile 50 in the Y-axis braze spacing 42.

In accordance with an embodiment of the present invention, the retaining groove 30 forms the bottom of the braze reservoir 44. The Z-axis depth and Y-axis width of the retaining groove 30 provides the ability to hold extra bonding material in the braze reservoir 44. The extra bonding material in the braze reservoir 44 helps the bonding layer formed in the braze spacing 40 between the generally planar top seating face 20 of the backing plate 10 and the generally planar bottom seating face 60 of the wear-resistant tile 50 to be sealed off from corrosion. In accordance with an embodiment of the present invention, the braze reservoir 44 may also help prevent galvanic corrosion between the backing plate 10 and the wear-resistant tile 50. The corrosion inhibiting zone provided by the braze reservoir 44 may act as a stop to corrosion that may infiltrate the bonding layer between backing plate 10 or the wear-resistant tile 50.

As shown in FIGS. 5 and 6, the backing plate 10 comprises a bottom mounting face 32 to allow the backing plate 10 to be fixedly attached to a helical screw or scroll of a conventional decanter centrifuge (not shown). The bottom mounting face 32 of the backing plate 10 may be fixed to the helical screw by any suitable method known to those skilled in the art, for example, welding, adhesives, mechanical fasteners or the like. The bottom mounting face 32 may be varied in size and shape depending on the size and configuration of the helical screw of the decanter centrifuge.

As shown in detail in FIG. 10, the wear-resistant tile 50 includes the front edge 52, the rear seating edge 54, first and second sides 56 and 58, the generally planar top surface 59 and the generally planar bottom seating face 60. In the embodiment shown, the first and second sides 56 and 58 extend from the rear seating edge 54 to the front edge 52 at an outward angle to form a generally trapezoidal wear-resistant tile 50. However, any other suitable shape of wear-resistant tile 50 may be used, e.g., rectangular, square, triangular, or the like. In the embodiment shown, the first and second sides 56 and 58 extend at the same outward angle as the first and second sides 16 and 18 of the backing plate 10. As shown in FIGS. 1 and 2, this results in the first and second sides 56 and 58 of the wear-resistant tile 50 aligning with the first and second sides 16 and 18 of the backing plate 10. In accordance with another embodiment of the present invention, the first and second sides 56 and 58 may extend at an outward angle greater than the outward angle of the first and second sides 16 and 18 of the backing plate 10 to allow the sides of the wear-resistant tile 50 to extend beyond sides of the backing plate 10. In accordance with an embodiment of the present invention, the front edge 52 extending from the first side 56 to the second side 58 may be curved, however any other suitable shape may be used, e.g., a straight edge.

As shown in detail in FIGS. 10 and 11, the generally planar top surface 59 and the generally planar bottom seating face 60 of the wear-resistant tile 50 extend in parallel planes from the front edge 52 toward the rear seating edge 54. As described above, the rear seating edge 54 includes an alignment notch 62 recessed from the rear seating edge 54 towards the front edge 52 of the wear-resistant tile 50. In accordance with an embodiment of the present invention, the alignment notch 62 shown in FIG. 11 is generally semicircular corresponding to the semicircular alignment protrusion 26 of the backing plate 10. However, any other suitable shape or type of alignment notch 62 may be used to receive the alignment protrusion 26, e.g., rectangular, square, triangular, serrated, complex curved, or the like. In the embodiment shown, there is a single centrally located alignment notch 62, but any other suitable number and location of alignment notch may be used, e.g., the rear seating edge 54 may include more than one alignment notch spaced along rear seating edge. In accordance with an embodiment of the present invention, if the rear seating edge 54 includes more than one alignment notch 62, each alignment notch may be of the same or different shape.

In accordance with an embodiment of the present invention, when the alignment notch 62 engages the alignment protrusion 26, the alignment notch 62 may be sized and configured to allow at least a portion of the alignment notch 62 to be spaced from the alignment protrusion 26 of the backing plate 10 and at least a portion of the alignment notch 62 to contact the alignment protrusion 26 of the backing plate 10. The spacing between the alignment notch 62 and alignment protrusion 26 may allow for the bonding material to flow from the braze reservoir 44 to form a bonding layer between a portion of the alignment notch 62 and the alignment protrusion 26 in the Y-axis braze spacing 42. When a portion of the alignment notch 62 of the wear-resistant tile 50 contacts a portion of the alignment protrusion 26 of the backing plate 10, the wear-resistant tile 50 is restricted from moving on the backing plate 10 in both the X-axis and Y-axis directions. The alignment protrusion 26 engaging the alignment notch 62 provides a desired orientation between the wear-resistant tile 50 and the backing plate 10 in the X-axis direction. In accordance with an embodiment of the present invention, the desired orientation between the wear-resistant tile 50 and the backing plate 10 in the X-axis direction allows the first and second sides 56 and 58 of the wear-resistant tile 50 to align with the first and second sides 16 and 18 of the backing plate 10 without the need to complete the time-consuming process of grinding the wear-resistant tile 50.

As shown in detail in FIGS. 10-13, the wear-resistant tile 50 comprises the alignment tabs 70 and spacing feet 72 extending from the generally planar bottom seating face 60 in the Z-axis direction. In the embodiment shown, the generally planar bottom seating face 60 comprises two oblong alignment tabs 70 having a generally semicircular cross-section. In accordance with an embodiment of the present invention, the alignment tabs shown in FIG. 12 have a semicircular cross-section to correspond to the semicircular cross-section of the retaining groove 30 of the backing plate 10. However, any other suitable shape and cross-sectional shape of alignment tabs may be used, e.g., rectangular, square, trapezoidal, hexagonal, ovular, triangular, or the like. In the embodiment shown in FIGS. 10 and 11, the alignment tabs 70 have an X-axis length that is greater than the Y-axis width. For example, the ratio of the X-axis length to the Y-axis width may be from 1:1 to 10:1, or from 2:1 to 5:1. However, in accordance with an embodiment of the present invention, the X-axis length of the alignment tabs 70 may be equal to or less than the Y-axis width.

Figure 12:
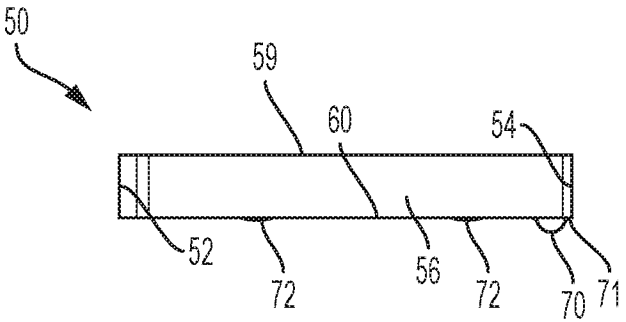
FIG. 12 is a side view of the wear-resistant tile of FIG. 10.

As shown in FIGS. 11 and 12, the alignment tabs 70 may extend from the generally planar bottom seating face 60 at a Y-axis offset distance 71 from the rear seating edge 54 of the wear-resistant tile 50. The Y-axis offset distance 71 allows the alignment tabs 70 to contact a side of the retaining groove 30 to provide proper and consistent alignment between the wear-resistant tile 50 the backing plate 10 in the Y-axis direction, as shown in FIG. 4. In the embodiment shown, the wear-resistant tile 50 comprises two alignment tabs 70, but any other suitable number of alignment tabs may be used, e.g., one, three, four or more. In accordance with an embodiment of the present invention, and as previously discussed herein, the alignment tabs 70 have a Z-axis extension distance selected to allow the alignment tabs to be spaced from the bottom of the retaining groove 30 resulting in a desired minimum bonding layer thickness.

As shown in FIGS. 10-12, the generally planar bottom seating face 60 includes three circular spacing feet 72. However, any other suitable shape of spacing feet may be used, e.g., rectangular, square, trapezoidal, hexagonal, ovular, triangular, or the like. In the embodiment shown, the generally planar bottom seating face 60 includes three spacing feet 72 with the first spacing foot 72 aligned with the first alignment tab 70, the second spacing foot 72 aligned with the center of the alignment notch 62, and the third spacing foot 72 aligned with the second alignment tab 70. However, any other suitable arrangement and number of spacing feet may be used, e.g., one, two, four, or more spacing feet, and/or the spacing feet may not be aligned with the additional features of the wear-resistant tile 50. In accordance with an embodiment of the present invention, the spacing feet 72 extend from the generally planar bottom seating face 60 to contact the generally planar top seating face 20 of the backing plate 10. As shown in FIGS. 3 and 4, the extension distance of the spacing feet 72 is selected to provide the desired braze spacing 40 in the Z-axis direction between the generally planar top seating face 20 of the backing plate 10 and the generally planar bottom seating face 60 of the wear-resistant tile 50. For example, the spacing feet 72 may extend from the generally planar bottom seating face 60 of the wear-resistant tile 50 a distance of from 0.0001 to 0.1 inch, or from 0.0005 to 0.05 inch, or from 0.001 to 0.01 inch. In a particular embodiment, the spacing feet 72 may extend from the generally planar bottom seating face 60 a distance of 0.005 inch. The spacing feet 72 allow for the desired amount of Z-axis braze spacing 40 to be provided between the backing plate 10 and the wear-resistant tile 50 consistently without user error. The spacing feet 72 may also allow for pressure to be applied to the top surface 59 of the wear-resistant tile 50 during bonding to prevent the bonding layer from being too thick. When pressure or weight is applied to the top surface 59 of the wear-resistant tile 50, the spacing feet 72 prevent the generally planar bottom seating face 60 from being pressed against the generally planar top seating face 20 of the backing plate 10. Although in the embodiment shown, the spacing feet 72 are provided on the wear-resistant tile 50, it is to be understood that generally planar top seating face 20 of the backing plate 10 may, alternatively or in addition, include spacing feet to control the Z-axis braze spacing 40.

In accordance with an embodiment of the present invention, the alignment and mounting structural features of the backing plate 10 and the wear-resistant tile 50 act to consistently achieve a desired optimal bonding layer thickness. As understood by those skilled in the art, when a bonding layer does not achieve the desired optimal thickness, a weak bond is formed and often leads to failure. The ability to control the Z-axis braze spacing 40 and Y-axis braze spacing 42 allows for a repeatable guide to achieving the desired optimal bonding layer thickness.

In accordance with an embodiment of the present invention, the backing plate 10 and the wear-resistant tile 50 may be bonded together using a material to fill the braze spacing 40 and 42 and the braze reservoir 44 to form a bonding layer having an optimal bonding layer thickness. In accordance with an embodiment of the present invention, the wear-resistant tile 50 may be brazed to the backing plate 10 with a braze material filling the braze spacing 40 and 42 and the braze reservoir 44 to form the bonding layer. In accordance with an embodiment of the present invention, any suitable conventional method of brazing and braze material may be used, e.g., induction brazing, furnace brazing and the like. In accordance with an embodiment of the present invention, the braze material may be applied in the Z-axis braze spacing 40 and melted to fill the braze reservoir 44 and the Y-axis braze spacing 42. The braze material provided in the Z-axis braze spacing 40 may have a material volume that is at least 10 percent more than the material needed to provide the desired braze joint thickness in the Z-axis braze spacing 40 to allow the desired braze joint thickness to also be provided in the braze reservoir 44 and the Y-axis braze spacing 42. For example, the material volume of the braze material in the Z-axis braze spacing 40 may be from 20 to 200 percent more, or from 50 to 150 percent more, or from 80 to 120 percent more than the material needed to provide the desired optimal braze joint first bonding layer thickness in the Z-axis braze spacing 40. However, as understood by those skilled in the art, the braze material may be applied in the Z-axis braze spacing 40, the Y-axis braze spacing 42 and the braze reservoir 44 before the centrifuge tile assembly 5 is heated. As understood by those skilled in the art, the backing plate 10 and the wear-resistant tile 50 may alternatively be bonded together in any suitable manner, such as with an adhesive material filling the braze spacing 40 and 42 and the braze reservoir 44, e.g., epoxy and the like.

In accordance with an embodiment of the present invention, the alignment protrusion 26 and the retaining groove 30 of the backing plate 10, and the alignment notch 62, the alignment tabs 70 and the spacing feet 72 of the wear-resistant tile 50 allow the mating of the backing plate 10 and the wear-resistant 50 to be self-fixturing for optimal brazing. Further, as previously discussed herein, the structural features of the backing plate 10 and the wear-resistant tile 50 provides the braze spacing 40 and 42 and the braze reservoir 44 to allow for an optimal bonding layer thickness of braze material to be achieved.

Figure 14:
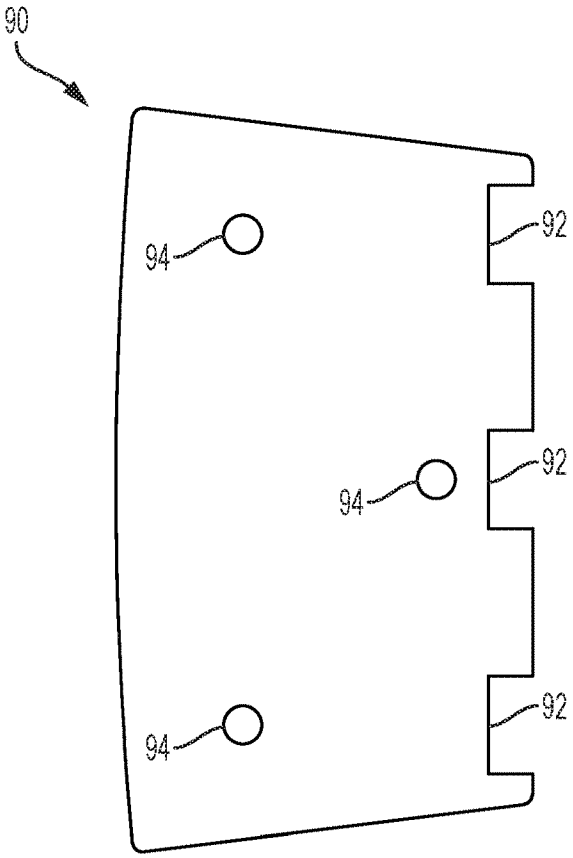
FIG. 14 is a top view of the braze shim of FIG. 13.
Figure 13:
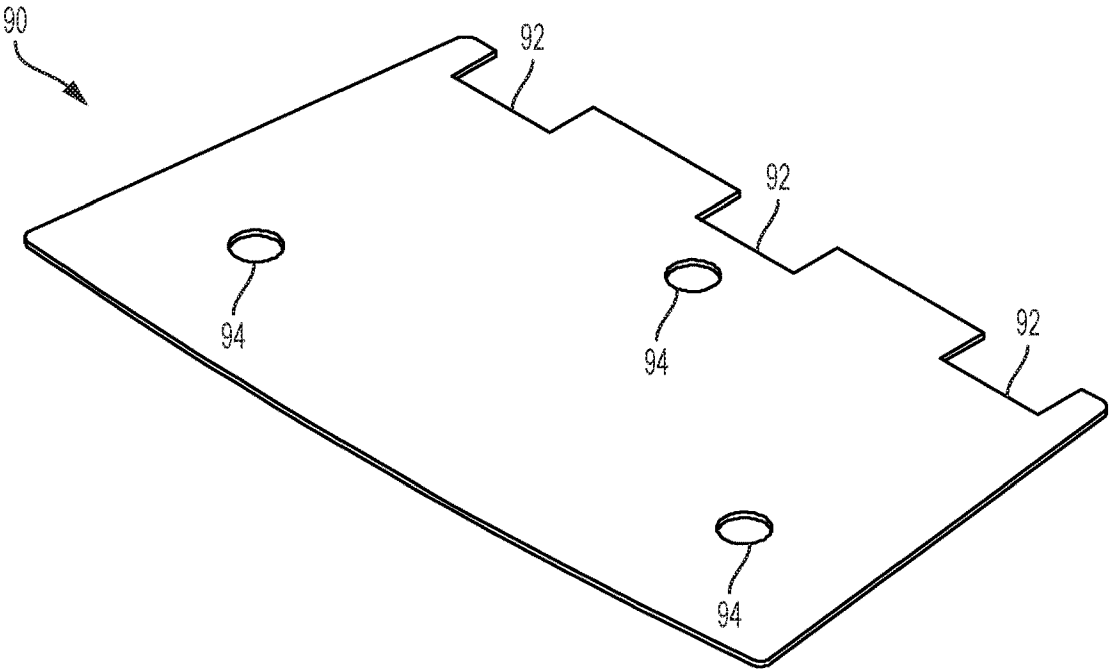
FIG. 13 is a front isometric view of a braze shim in accordance with an embodiment of the present invention.

As shown in FIG. 13, a braze shim 90 may be used during a brazing process to provide the bonding layer between the backing plate 10 and the wear-resistant tile 50. The braze shim 90 may have a size and shape corresponding to the generally planar top seating face 20 of the backing plate 10 and the generally planar bottom seating face 60 of the wear-resistant tile 50. In the embodiment shown in FIG. 14, the braze shim 90 includes edge recesses 92 and thru-holes 94 corresponding to the structural features of the backing plate 10 and the wear-resistant tile 50. Aligning the edge recesses 92 with the alignment protrusion 26 of the backing plate 10 and the alignment tabs 70 of the wear-resistant tile 50, and the thru-holes 94 with the spacing feet 72 of the wear-resistant tile 50 provides consistent and repeatable alignment of the braze shim 90 between the backing plate 10 and the wear-resistant tile 50. In the embodiment shown, the braze shim 90 is provided in the Z-axis braze spacing 40 and is melted to also fill the Y-axis braze spacing 42 and the braze reservoir 44, however, in an accordance with an embodiment of the present invention, the braze shim 90 may be sized and shaped to include a Y-axis braze spacing portion and a braze reservoir portion.

In accordance with an embodiment of the present invention, the braze shim 90 may have a material volume that is at least 10 percent more than the material needed to provide the desired braze joint thickness in the Z-axis braze spacing 40 to allow the desired braze joint thickness to also be provided in the braze reservoir 44 and the Y-axis braze spacing 42 when the braze shim 90 melts, for example the material volume of the braze shim 90 may be from 20 to 200 percent more, or from 50 to 150 percent more, or from 80 to 120 percent more than the material needed to provide the desired optimal braze joint first bonding layer thickness in the Z-axis braze spacing 40. In a particular embodiment, to obtain a bonding layer having a thickness of 0.005 inch, a braze shim 90 having a thickness of 0.01 inch may be used to fill the braze spacing 40 and 42 and the braze reservoir 44. In accordance with an embodiment of the present invention, when the braze shim 90 melts, the braze material flows to fill the braze reservoir 44 and may then flow from the braze reservoir 44 into the Y-axis braze spacing 42 by capillary action to form the second bonding layer. In certain embodiments, the excess material may provide a fillet on the exterior portions of the joint between the backing plate 10 and the wear-resistant tile 50.

In accordance with an embodiment of the present invention, to make a centrifuge tile assembly 5, the backing plate 10 is provided and a braze shim 90 as shown in FIG. 13 may be placed onto the generally planar top seating face 20 of the backing plate 10 with the central edge recess 92 of the braze shim 90 aligned with the alignment protrusion 26 of the backing plate 10. The wear-resistant tile 50 is placed onto the braze shim 90 and the backing plate 10 with the alignment tabs 70 aligned with the outer edge recesses 92, and the spacing feet 72 aligned with the thru-holes 94. The spacing feet 72 of the wear-resistant tile 50 contact the generally planar top seating face 20 of the backing plate to form the Z-axis braze spacing 40. The alignment notch 62 of the wear-resistant tile 50 engages the alignment protrusion 26 of the backing plate 10, and the alignment tabs 70 of the wear-resistant tile 50 engage the retaining groove 30 of the backing plate 10 to provide the Y-axis braze spacing 42. Pressure or weight may be applied to the generally planar top surface 59 of the wear-resistant tile 50. The backing plate 10, braze shim 90, and wear-resistant tile 50 may then be heated by induction or furnace brazing to a temperature sufficient to melt the braze material to form the first bonding layer in the Z-axis braze spacing 40, to flow and fill the braze reservoir 44, and to flow and form the second bonding layer in the Y-axis braze spacing 42.

The backing plate 10 may be made of any suitable conventional material, such as steel, stainless steel, aluminum, titanium or any other material having sufficient strength. The backing plate 10 of the present invention may be fabricated by any suitable technique, such as casting, investment casting, or machining, to provide the alignment protrusion and retaining groove. The wear-resistant tile 50 may be made of any suitable conventional material, such as cemented carbides, and Superhard materials, such as Cubic Boron Nitride (CBN), Polycrystalline Cubic Boron Nitride (PCBN), Polycrystalline Diamonds (PCD), tungsten carbide (WC), cemented tungsten carbide, cermet, ceramic, and the like. The wear-resistant tile 50 of the present invention may be fabricated by any suitable technique, such as molding and/or machining, to provide the alignment tabs, spacing feet, and alignment notch. The braze material may be made of any suitable conventional material, such as silver-based alloys and the like.

Figure 15:
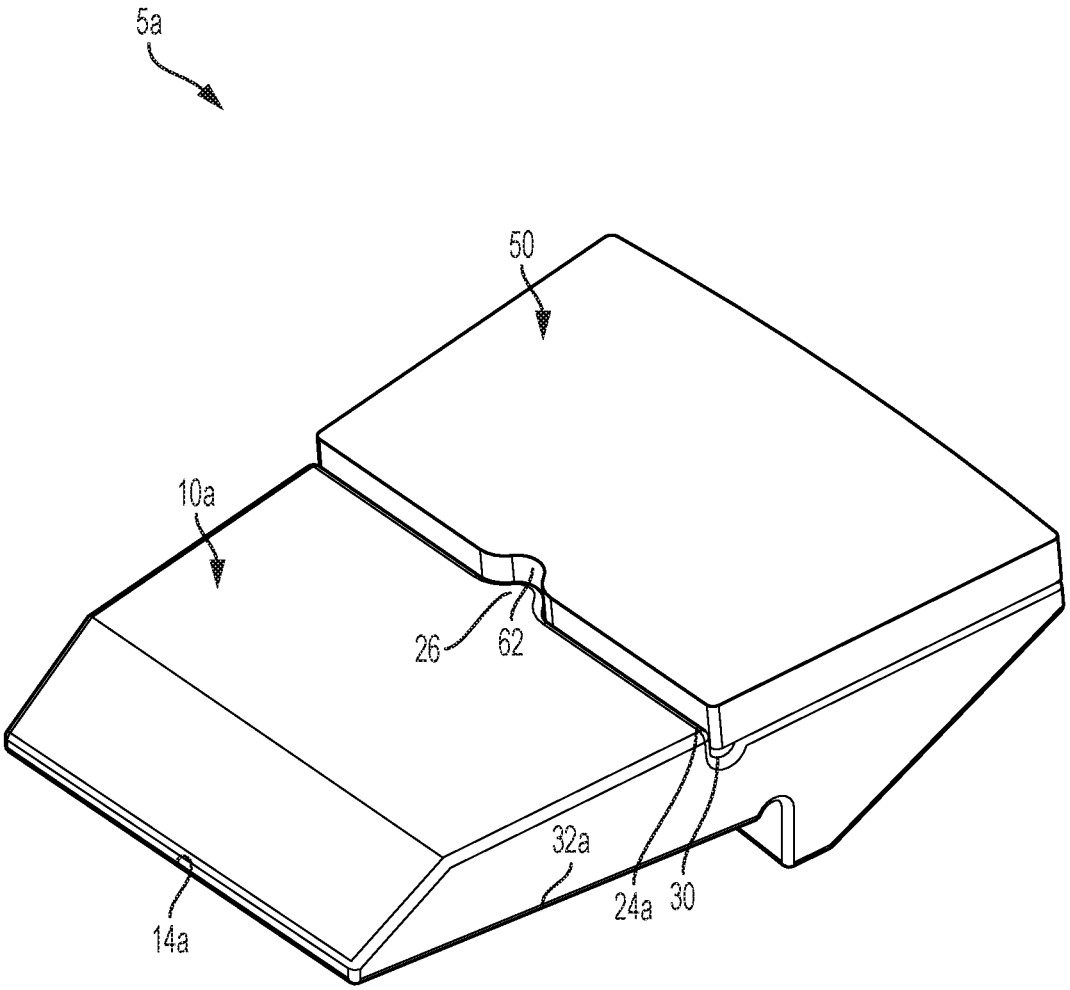
FIG. 15 is a top-rear isometric view of a centrifuge tile assembly in accordance with another embodiment of the present invention.

FIG. 15 illustrates a centrifuge tile assembly **5*a* in accordance with another embodiment of the present invention. Similar element numbers are used in FIG. 15 for common features that are present in the embodiment of FIGS. 1-12. As shown in FIG. 15, the backing plate 10*a* may have a distance between the rear edge 14*a* and the vertical seating face 24*a* that is greater than the embodiment shown in FIGS. 1-12. The vertical length of the bottom mounting face 32*a* may be varied depending on the distance between the rear edge 14*a* and the vertical seating face 24*a*. As shown in FIG. 15, the size and shape of the backing plate 10*a* may be varied depending on the mounting requirements for the helical screw of a decanter centrifuge. In accordance with an embodiment of the present invention, the size and shape of the wear-resistant tile 50 may be varied depending on the size and shape of the backing plate 10*a***.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

For purposes of the description above, it is to be understood that the invention may assume various alternative variations and step sequences except where expressly specified to the contrary. Moreover, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A centrifuge tile assembly comprising:

a backing plate comprising a generally planar top seating face extending from a front edge of the backing plate toward a vertical seating face of a rear mounting shoulder of the backing plate; and a wear-resistant tile comprising a front edge, a distal-most rear seating edge opposite the front edge at a peripheral edge of the wear-resistant tile, first and second sides, a continuous and uninterrupted top surface and a generally planar bottom seating face, wherein the backing plate and the wear-resistant tile define an X-axis parallel with a plane of the generally planar top seating face of the backing plate, parallel with a plane of the generally planar bottom seating face of the wear-resistant tile, and extending parallel to the distal-most rear seating edge of the wear-resistant tile, and a Y-axis parallel with the plane of the generally planar top seating face of the backing plate, parallel with a plane of the generally planar bottom seating face of the wear-resistant tile, and extending normal to the distal-most rear seating edge of the wear-resistant tile, and wherein at least one protrusion extending from the vertical seating face of the backing plate engages at least one opposing recess recessed from the distal-most rear seating edge of the wear-resistant tile to thereby restrict relative movement between the backing plate and the wear-resistant tile in the X-axis direction and the Y-axis direction.

2. The centrifuge tile assembly of claim 1, wherein the backing plate comprises a retaining groove recessed in the generally planar top seating face, and wherein the wear-resistant tile comprises an alignment tab extending from the generally planar bottom seating face and structured and arranged to be received in the retaining groove of the backing plate.

3. A centrifuge tile assembly comprising:

a backing plate comprising a generally planar top seating face extending from a front edge of the backing plate toward a rear mounting shoulder of the backing plate, a retaining groove recessed into and below the generally planar top seating face, and a vertical seating face on the rear mounting shoulder extending from the retaining groove below the generally planar top seating face and normal to the generally planar top seating face of the backing plate;

a wear-resistant tile comprising a top surface, a front edge, a rear seating edge, first and second sides and a generally planar bottom seating face, the generally planar bottom seating face comprising at least one alignment tab extending from the generally planar bottom seating face and structured and arranged to be received within the retaining groove of the backing plate; and a first bonding layer between the generally planar top seating face of the backing plate and the generally planar bottom seating face of the wear-resistant tile, and a second bonding layer between the vertical seating face of the backing plate and the rear seating edge of the wear-resistant tile.

4. The centrifuge tile assembly of claim 3, wherein the backing plate and the wear-resistant tile define an X-axis parallel with a plane of the generally planar top seating face of the backing plate, parallel with a plane of the generally planar bottom seating face of the wear-resistant tile, and extending parallel to the rear seating edge of the wear-resistant tile, and a Y-axis parallel with the plane of the generally planar top seating face of the backing plate, parallel with a plane of the generally planar bottom seating face of the wear-resistant tile, and extending normal to the rear seating edge of the wear-resistant tile.

5. The centrifuge tile assembly of claim 4, wherein the backing plate comprises an alignment protrusion extending from the vertical seating face, and wherein the rear seating edge of the wear-resistant tile comprises an alignment notch recessed from the rear seating edge and structured and arranged to receive the alignment protrusion of the backing plate to thereby restrict relative movement between the backing plate and the wear-resistant tile in the X-axis direction and the Y-axis direction.

6. The centrifuge assembly of claim 5, wherein at least a portion of the alignment notch of the wear-resistant tile is spaced from the alignment protrusion of the backing plate.

7. The centrifuge tile assembly of claim 4, wherein the at least one alignment tab of the wear-resistant tile is received in the retaining groove of the backing plate to provide a desired orientation between the wear-resistant tile and the backing plate in the Y-axis direction.

8. The centrifuge tile assembly of claim 4, wherein the backing plate and the wear-resistant tile define a Z-axis normal to the plane of the generally planar top seating face of the backing plate and normal to the plane of the generally planar bottom seating face of the wear-resistant tile, and wherein the generally planar bottom seating face of the wear-resistant tile comprises at least one spacing foot extending from the generally planar bottom seating face in the Z-axis.

9. The centrifuge tile assembly of claim 8, wherein the at least one spacing foot of the wear-resistant tile contacts the generally planar top seating face of the backing plate to provide a Z-axis braze spacing between the generally planar top seating face of the backing plate and the generally planar bottom seating face of the wear-resistant tile.

10. The centrifuge tile assembly of claim 4, wherein the wear-resistant tile comprises first and second alignment tabs extending from the generally planar bottom seating face at a Y-axis offset distance from the rear seating edge.

11. The centrifuge tile assembly of claim 3, wherein the first side of the wear-resistant tile is aligned with a first side of the backing plate and the second side of the wear-resistant tile is aligned with a second side of the backing plate.

12. The centrifuge tile assembly of claim 3, wherein the at least one alignment tab of the wear-resistant tile is spaced from a bottom surface of the retaining groove of the backing plate.

13. The centrifuge tile assembly of claim 3, wherein the rear seating edge of the wear-resistant tile is spaced from the vertical seating face of the backing plate to provide a Y-axis braze spacing.

14. The centrifuge tile assembly of claim 3, wherein the retaining groove of the backing plate extends from a first side of the backing plate to a second side of the backing plate.

15. The centrifuge tile assembly of claim 3, wherein the backing plate and the wear-resistant tile define a Z-axis normal to the plane of the generally planar top seating face of the backing plate and normal to the plane of the generally planar bottom seating face of the wear-resistant tile, and wherein a Z-axis distance between the generally planar bottom seating face of the wear-resistant tile and the retaining groove of the backing plate forms a braze reservoir.

16. The centrifuge tile assembly of claim 3, wherein the first and second bonding layers have a thickness of at least 0.0025 inches.

17. The centrifuge tile assembly of claim 3, wherein the first and second bonding layers are formed by a braze material.

18. The centrifuge tile assembly of claim 17, wherein the braze material is provided as a braze shim comprising at least one edge recess structured and arranged to receive the at least one alignment tab of the wear-resistant tile, and at least one thru-hole structured and arranged to receive at least one spacing foot of the wear-resistant tile.

19. The centrifuge tile assembly of claim 3, wherein the backing plate is stainless steel and the wear-resistant tile is cemented tungsten carbide.

20. A backing plate for a centrifuge tile assembly comprising:

a generally planar top seating face extending from a front edge of the backing plate toward a rear mounting shoulder of the backing plate, a retaining groove recessed in the generally planar top seating face, a vertical seating face on the rear mounting shoulder extending from the retaining groove below the generally planar top seating face, and a semicircular alignment protrusion integrally formed with the vertical seating face and extending from the retaining groove below the generally planar top seating face, wherein the retaining groove comprises a first side transitioning into the generally planar top seating face and a second side transitioning into the vertical seating face.

21. A wear-resistant tile for a centrifuge tile assembly comprising:

a generally planar top surface, a front edge, a rear seating edge comprising a generally planar portion, first and second sides and a generally planar bottom seating face, wherein the generally planar bottom seating face comprises at least one alignment tab extending from the generally planar bottom seating face structured and arranged to be received within a recessed retaining groove of a backing plate, and an alignment notch recessed from the rear seating edge structured and arranged to receive an alignment protrusion of the backing plate.

* * * * *